US005407074A

United States Patent [19]

Brightbill et al.

[11] Patent Number: 5,407,074

[45] Date of Patent: Apr. 18, 1995

[54] STORAGE DRAWER ASSEMBLY

[75] Inventors: Keith Brightbill; Brian J. Conaway, both of Wooster; Coy D. Ward, Norton, all of Ohio

[73] Assignee: Rubbermaid Incorporated, Wooster, Ohio

[21] Appl. No.: 238,007

[22] Filed: May 3, 1994

[51] Int. Cl.[6] ..... B65D 21/036

[52] U.S. Cl. ..... 206/511; 206/508; 206/509; 220/212; 220/4.27

[58] Field of Search ..... 206/511, 509, 508, 505, 206/503, 821; 220/23.6, 23.86, 212, 630, 632, 636, 628, 625, 4.27, 4.26

[56] References Cited

U.S. PATENT DOCUMENTS

| | | | |
|---|---|---|---|
| 2,614,016 | 10/1952 | Regenhardt | 206/509 |
| 2,676,080 | 4/1954 | Stedman | 206/509 |
| 3,001,564 | 9/1961 | Hopkins | 206/509 |
| 3,079,037 | 2/1963 | Schechter | 220/212 |
| 3,974,898 | 8/1976 | Tullis et al. | 190/3 |
| 4,040,538 | 8/1977 | Gerson | 220/212 |
| 4,119,204 | 10/1978 | Peckar | 206/521 |
| 4,239,309 | 12/1980 | De Fouw | 312/221 |
| 4,287,997 | 9/1981 | Rolfe et al. | 206/511 |
| 4,293,072 | 10/1981 | Hill et al. | 206/509 |
| 4,865,404 | 9/1989 | Harper | 312/221 |
| 5,190,156 | 3/1993 | Conaway et al. | 206/509 |

FOREIGN PATENT DOCUMENTS

| | | | |
|---|---|---|---|
| 650406 | 1/1929 | France | 206/511 |
| 1412553 | 8/1965 | France | 206/508 |

*Primary Examiner*—Stephen J. Castellano
*Attorney, Agent, or Firm*—Richard B. O'Planick; Lisa B. Riedesel

[57] ABSTRACT

A stacking drawer assembly (10) is disclosed comprising a base (14), lid (12), and drawer (16). A bottom surface (35) of the base (14) is provided with a central recess (38) and a pair of locking tabs (44) extend into the recess from a rearward recess sidewall (42) of the base (14). The lid (12) has a central raised pedestal (22) and a pair of spaced apart slots (50) extend through a rearward pedestal side (28). The base recess (38) is sized to receive the pedestal (22) of a second drawer assembly in stacking fashion, and the tabs (44) project through the slots (50) and latch over an inside surface edge defining the slots (50) to lock the stacked drawer assemblies together.

12 Claims, 6 Drawing Sheets

STORAGE DRAWER ASSEMBLY

BACKGROUND OF THE INVENTION

1. Field of the Invention

The present invention relates generally to modular stacking drawer units, and more specifically to such units which are formed of plastics material and intended to stack one upon another in a vertical array.

2. The Prior Art

Modular container units which stack one upon another are well known consumer products. Typically such units comprise a base and a lid component, with the upper surface of the lid adapted to register within the bottom of the base of a second unit, whereby enabling the base of the second unit to stack upon the lid of the first. In so doing, a vertical stacked array is formed for household storage of small items.

It is also known to adapt the container base to form a drawer assembly. The base is formed having an open side into which a drawer component can be slid in reciprocal fashion. Thus, the vertically stacked array of multiple units forms a drawer assembly, enabling the user to access the contents of the units by pulling out the appropriate drawer.

While the aforementioned consumer products work well and have found consumer acceptance, certain shortcomings prevent them from achieving an optimal satisfaction of the consumer's needs. First, in creating a vertical stack of multiple modular drawer units, an unstable situation can result whereby pulling the loaded drawer of a given modular unit may cause that unit to move relative to the stack, resulting in tipping. Secondly, lateral stability of a vertical stack is also typically less than desirable, since the registration of the currently available units together does not result in a structurally dependable interconnection and can result in the uppermost units toppling from the stack if bumped from the side. In summary, available stacked drawer or container units lack a dependable interconnection with each other which would make their separation in any direction unlikely.

SUMMARY OF THE PRESENT INVENTION

The subject invention comprises a stacking drawer assembly comprising a container base, lid, and drawer. The container base is three sided, having an open forward side for receiving the drawer component therein. The base bottom has a centrally disposed recess defined by recess sidewalls, and a pair of locking tabs project into the recess from a rearward recess sidewall. Each tab has a rectangular main portion, connected at one end to the rearward recess sidewall and extending coplanar with the bottom surface of the base. At the inward end, each tab has a locking flange.

The lid component is adapted to provide a central raised pedestal or plateau portion, defined by vertical sides. The rearward pedestal side has slots formed therethrough corresponding in placement and configuration to the base tabs. Accordingly, two units may be interconnected together by placing the lid pedestal of a lower unit within the base recess of an upper unit, and moving the upper base forward. Whereupon, the tab projections of the upper base enter the slots of the lower container lid and latch over an internal lip. The two units are thereby maintained in an interlocking configuration, capable of remaining erect in a stacked orientation as the drawers of either unit are open or closed. Also, the spaced pair of tabs resist rotational movement between the stacked units.

Accordingly, it is an objective to provide a stacking drawer assembly having interlocking means for maintaining stacked container units in an upright condition.

A further objective is to provide a stacking drawer assembly having interlocking means for preventing relative rotational movement between stacked container units.

Yet a further objective is to provide a stacking drawer interlock system which is relatively unobtrusive in appearance and which is not readily noticeable to the user.

Another objective is to provide a stacking drawer interlock system which is integrally formed with the container units, requiring no assembly hardware or separate parts.

Still a further objective is to provide a stacking drawer interlock system which resists from all directions any force which would tend to topple or separate the stacked container units.

A further objective is to provide a stacking drawer assembly and interlock system which is economically and readily produced and which is readily assembled and utilized in practice.

These and other objectives, which will be apparent to those skilled in the art, are achieved by a preferred embodiment which is described in detail below and which is illustrated in the accompanying drawings.

DESCRIPTION OF THE ACCOMPANYING DRAWINGS

DESCRIPTION OF THE PREFERRED EMBODIMENT

Figure 1:
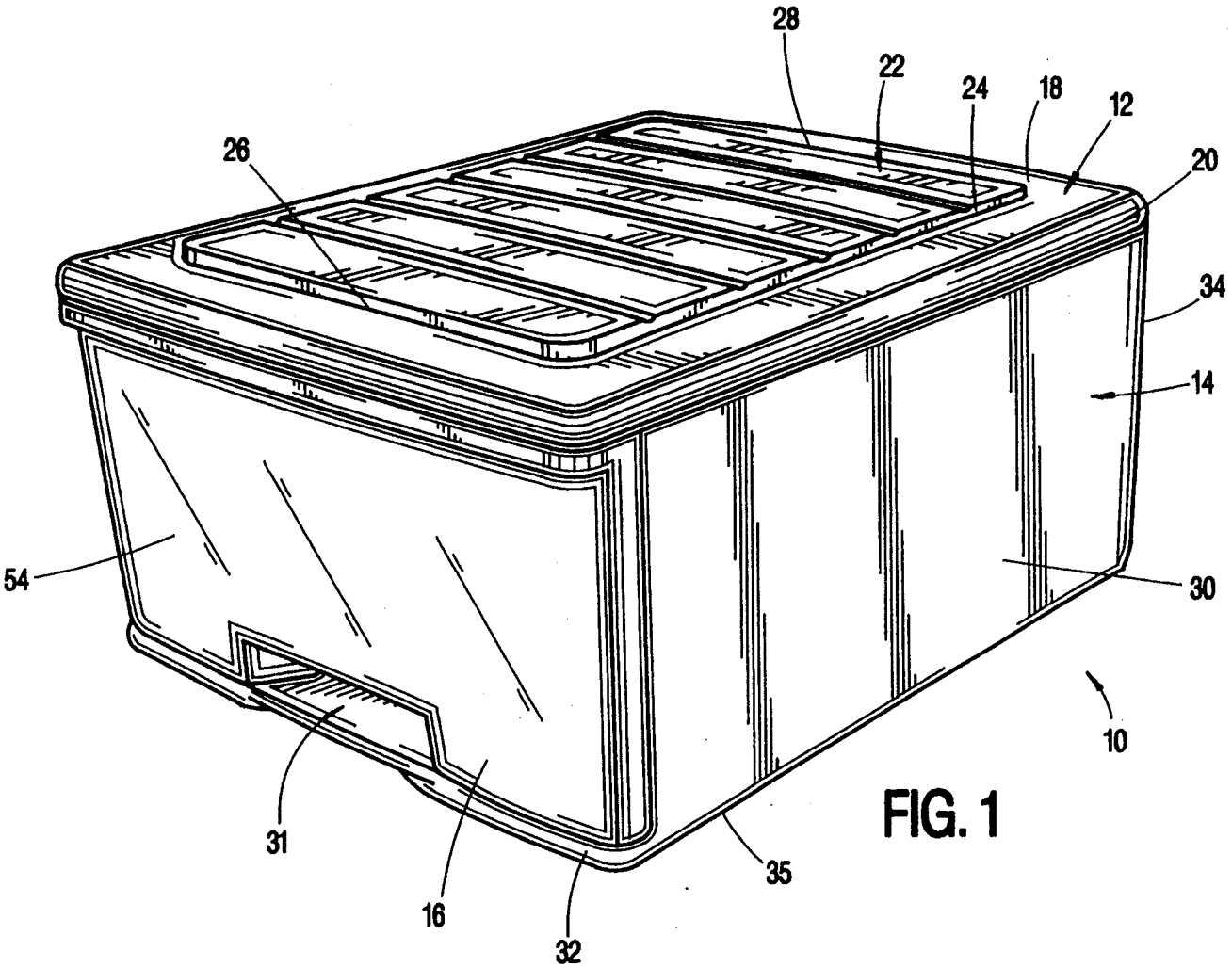
FIG. 1 is a front perspective view of the subject container, lid, and drawer assembly shown in the assembled condition.

Referring initially to FIG. 1, the subject drawer assembly unit 10 is shown to comprise three component pans: a lid 12, a base 14, and a drawer 16. The three parts are formed of conventional plastic material such as polypropylene, by conventional forming methods such as injection molding.

The lid component 12 is formed in a generally rectangular configuration, having a top surface 18 which terminates at a downturned peripheral rim flange 20. A central raised pedestal or plateau portion 22 is provided, formed having lateral pedestal sides 24, a forward pedestal side 26, and a rearward pedestal side 28.

The base component 14 is molded having four sides, namely two solid lateral base sides 30, a partially open forward side 32, and a solid rearward side 34. The forward base side 30 is adapted to provide a central opening 31 which communicates with the central chamber of the base component 14. The base component further includes a bottom surface 35 from which the sides 30, 32, and 34 project upward.

Figure 3:
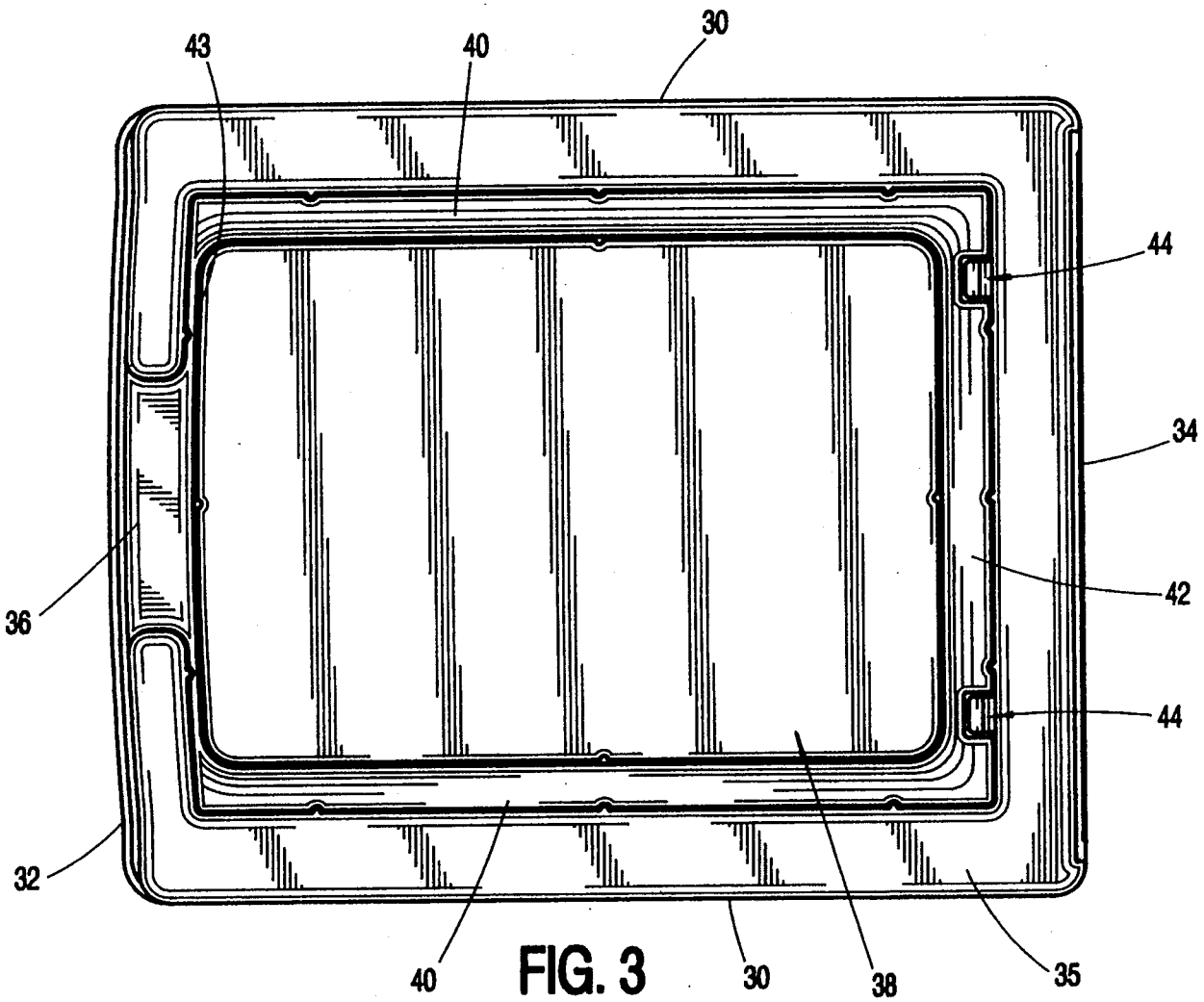
FIG. 3 is a bottom elevational view of the container base component.
Figure 4:
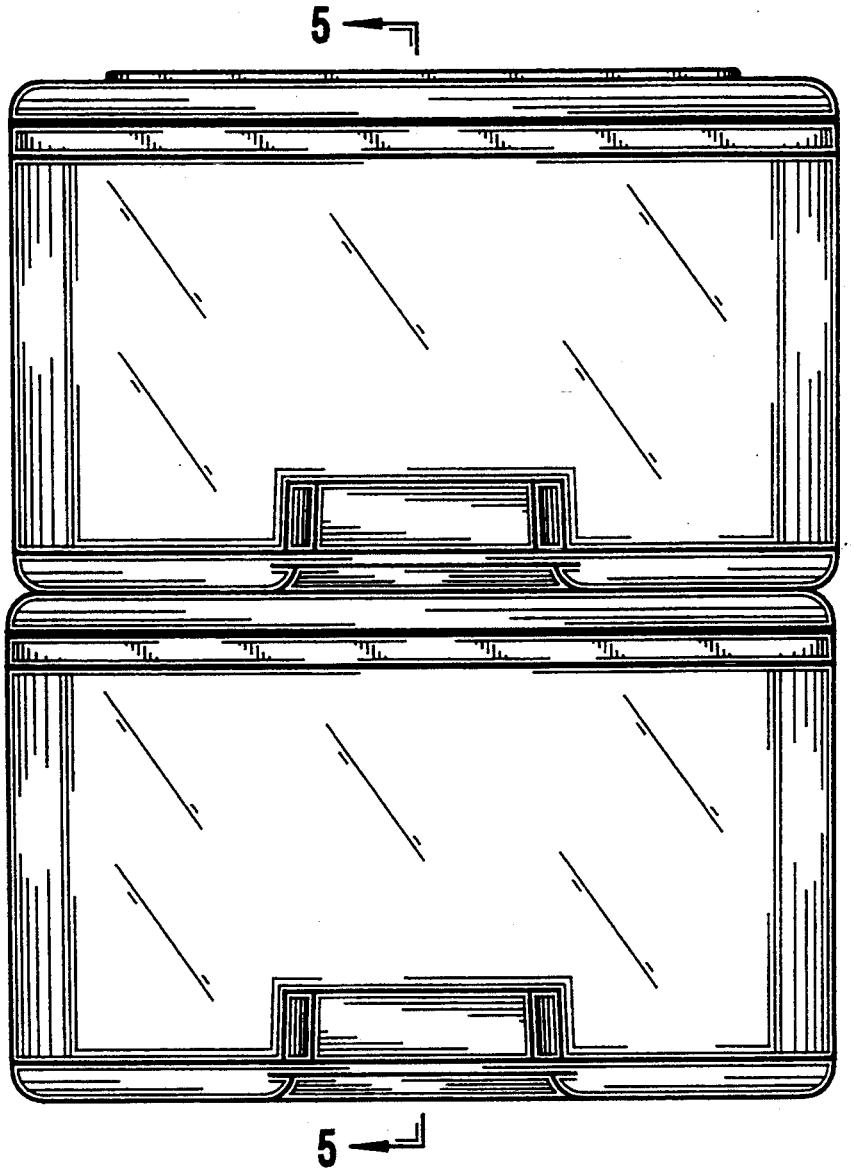
FIG. 4 is a front elevational view of one subject unit stacked upon a like-configured second unit.

Referring to FIGS. 1 and 3, a hand opening recess 36 is formed to extend into a lower edge of the drawer 16.

The bottom surface 35 of the base 14 is formed to include a rectangular central recess 38 framed by lateral recess sidewalls 40, a rearward recess sidewall 42, and a forward recess sidewall 43.

As best depicted by FIGS. 3 and 7, the a pair of spaced apart tab projections 44 are integrally formed with the base bottom surface 35 and extend into the recess 36. The tab projections 44 comprise a rectangular and flat body portion 46 which is connected at one end to the bottom surface 35, and extends generally co-planar with the surface 35. The opposite end of the tab projection 44 includes a transverse, downwardly directed retention flange 48 extending from one side of the tab projection to the opposite side. The purpose for the retention flanges will be readily understood from the following.

Figure 5:
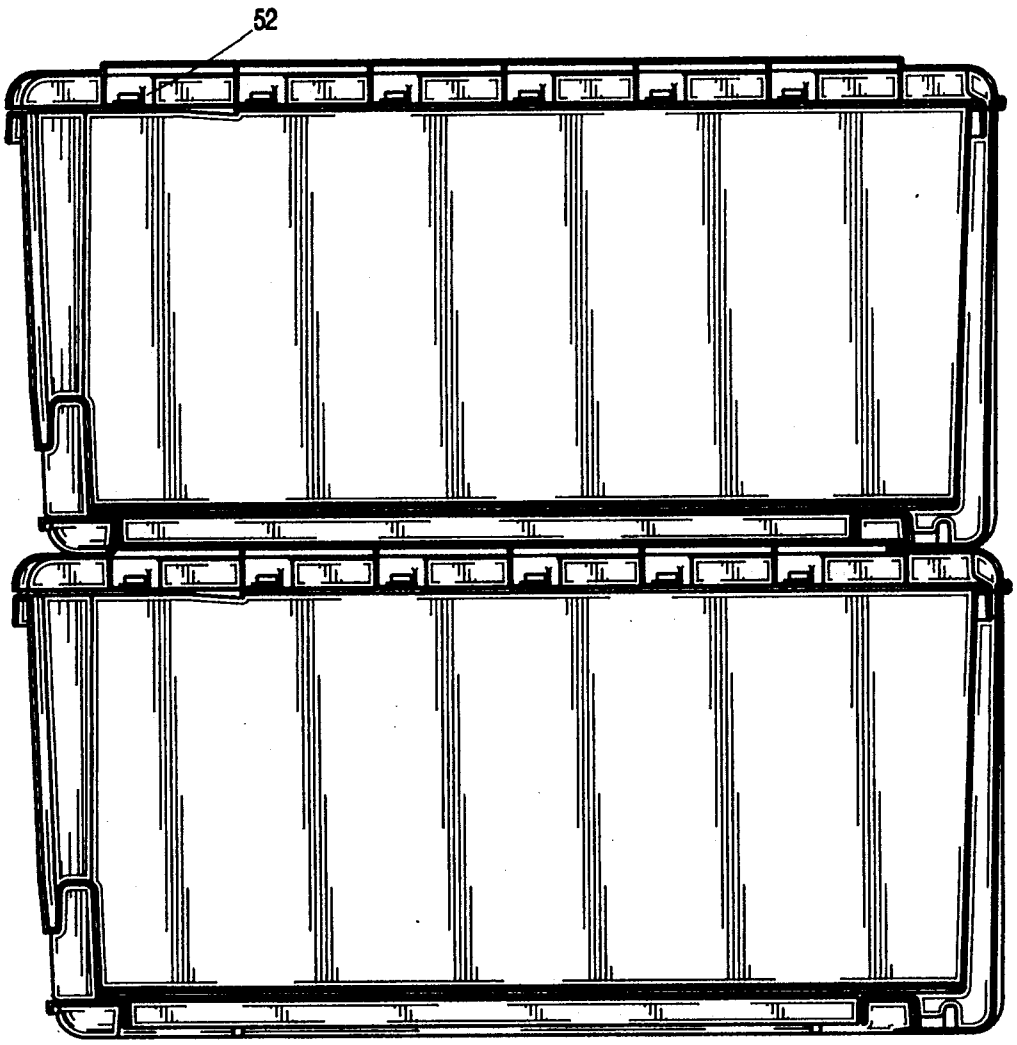
FIG. 5 is a longitudinal section view thereof, taken along the line 5—5 of FIG. 4.

The lid 12 fits upon and attaches to the upper rim of the base 14 in a manner known in the industry. The lid may be adapted to include inward flanges which engage an upper rim of the base, as one conventional method of attaching a plastic lid to a container. The subject embodiment, as shown in FIG. 5 utilize plastic tines 52 which project upward from the upper rim of the base 14 and which enter into appropriately spaced and sized sockets in the underside of the lid 12 to detachably connect the lid 12 to the base 14. The drawer 16 is housed within the base 14 and can be moved between a fully inserted position (shown in FIG. 1) to a partially withdrawn position in a conventional manner.

Figure 2:
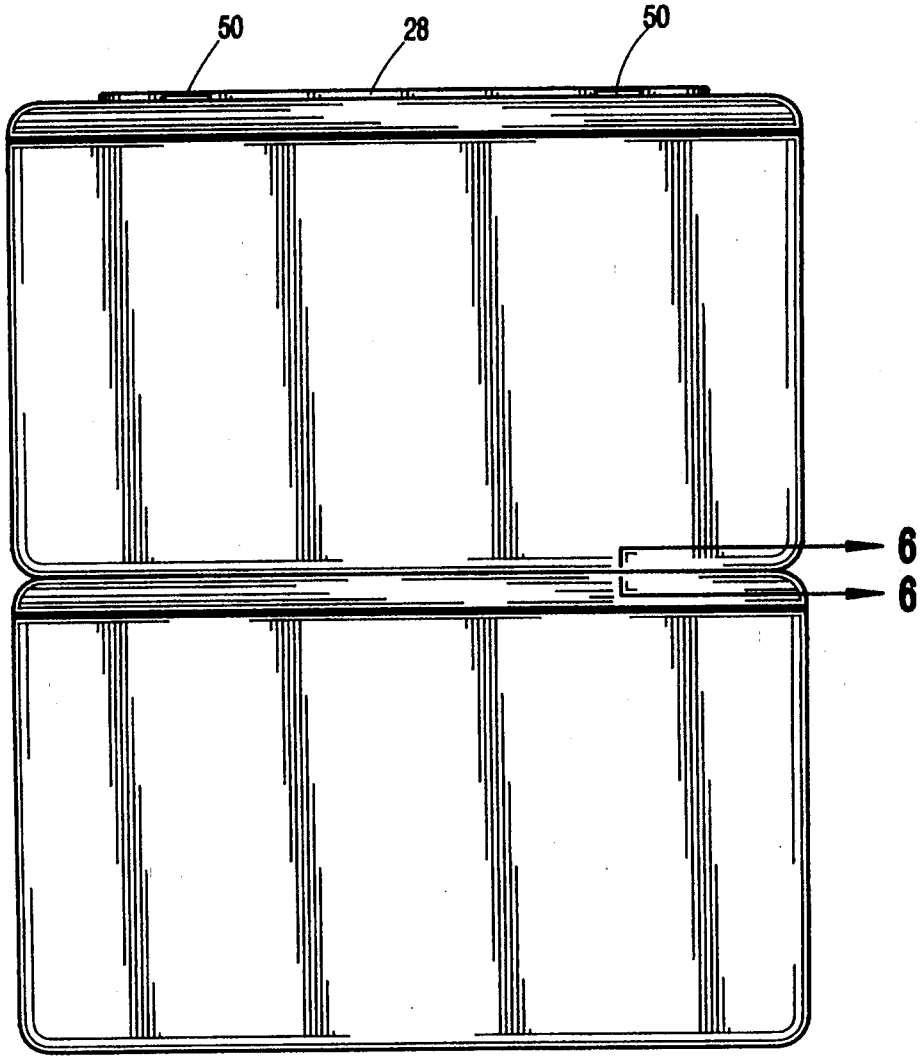
FIG. 2 is a rear elevational view of one subject unit stacked upon a like-configured second unit.
Figure 6:
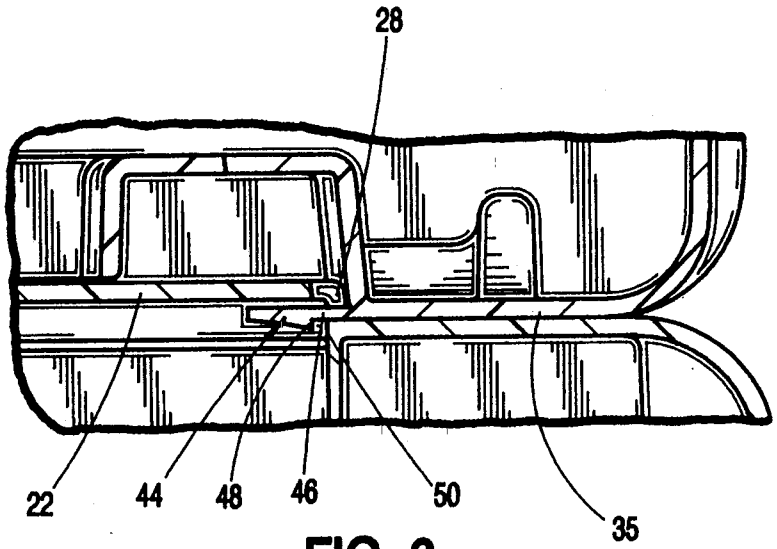
FIG. 6 is a partial section view through the container tab, taken along the line 6—6 of FIG. 2.

Referring to FIGS. 2, 5, and 6, the pedestal rearward sidewall 28 has a pair of rectangular slot openings 50 extending therethrough, located and sized to admit the tab projections 44 of a second container base. As will be appreciated, the subject container units 10 are intended to be stacked upon one another in a vertical array, with the base recess 38 of an upper unit centered upon and receiving therein the lid pedestal 22 of an underlying unit. Upon so positioning the container units, and moving the upper base rearward, the tab projections 44 enter into slots 50 until the tab flanges 48 ride over and engage a lower edge 56 defining the slots 50, whereby locking the stacked units together. So connected, the stack is stable and the top unit cannot be toppled from the bottom.

From FIGS. 1–6 and the foregoing, it will be apparent that the interlock achieved by the tab projections 44 accomplishes several important objectives. First, spaced apart location of the dual tab projections 44 not only secures the units together, but also inhibits any rotational movement between the stacked units. Secondly, the tab projections 44 are directed in the same direction as the drawer movement, which stabilizes the upper unit from moving relative to the lower unit as its drawer is open and closed. In addition, the tab projections are relatively unobtrusive in use, and stabilize the stack without aesthetic detriment.

The molded drawer assembly units require no assembly hardware to interlock, the tab projections and slots being integrally molded features. Moreover, the tab projections are in a relatively protected area of the underside of the base, which makes their breakage in transport or in use unlikely. Also, the tab projections are located such that they will not interfere with a base unit nesting within another base unit for shipment, whereby facilitating cost efficient transportation of the base components to their retail location.

While the above describes the preferred embodiment of the subject invention, the invention is not intended to be so limited. Other embodiments, which will be apparent to those skilled in the art, and which utilized the teachings herein set forth, are intended to be within the scope and spirit of the subject invention.

We claim:

1. A stacking container assembly, comprising:

a container base having a bottom surface and sidewalls extending upward from the bottom surface to an upper rim, and a bottom recess which extends into the bottom surface and is defined by recess sidewalls, and at least one locking tab connected at one end to a recess sidewall and having a remote second end portion projecting inwardly into the recess; and a container lid for covering the container base upper rim, the lid having a top surface and a top pedestal portion elevated above the top surface, the pedestal portion having a configuration adapted to fit into the bottom recess of a like-configured second container base, and the top pedestal portion having a slot opening extending through a pedestal portion sidewall, the opening adapted to closely receive a remote second end portion of a locking tab of the second container base therethrough when the second container is stacked upon the first container lid.

2. A container assembly according to claim 1, wherein the locking tab extends horizontally from the recess sidewall, coplanar with the container base bottom surface.

3. A container assembly according to claim 2, wherein the locking tab has retention means.

4. A container assembly according to claim 3, wherein the retention means comprises a transverse flange at the remote second end portion of the tab, and the transverse flange of the tab of the second container base being adapted to move over an edge surface of the slot opening.

5. A container assembly according to claim 1, wherein the locking tab is integrally molded with the container base recess sidewall.

6. A container assembly according to claim 1, wherein the container base has three sidewalls and an open forward side, the assembly further comprising a drawer component receivable into the container base through the forward side and moveable in a linear direction between an extended and a retracted position, and the drawer component moving into the base container in a direction opposite the direction in which the locking tab projects.

7. A container assembly according to claim 6, wherein the locking tab projecting parallel with the linear direction of the drawer component movement.

8. A stacking container assembly, comprising:

a container base having a bottom surface and sidewalls extending upward from the bottom surface to an upper rim, and a bottom recess which extends into the bottom surface and is defined by recess sidewalls, and at least one locking tab connected in cantilever manner at one end to a recess sidewall and projecting inwardly therefrom into the recess, the tab having a substantially flat elongate body portion extending outwardly from the one end and retention means at a remote second end of the body portion;

a container lid for covering the container base upper rim, the lid having a top surface and a top pedestal portion elevated above the top surface, the pedestal portion having a configuration adapted to fit into the bottom recess of a like-configured second container base, and the top pedestal portion having a slot opening extending through a pedestal sidewall dimensioned to closely receive the locking tab of the second container base therethrough.

9. A container assembly according to claim 8, wherein the locking tab extends horizontally from the recess sidewall, with the tab body portion lying substantially coplanar with the container base bottom surface.

10. A container assembly according to claim 8, wherein the retention means comprises a transverse flange at the remote second end of the tab, and the transverse flange of the tab of the second container base being adapted to engage over and edge surface of the slot opening.

11. A container assembly according to claim 10, wherein the container base has three sidewalls and an open forward side, the assembly further comprising a drawer component receivable into the container base through the forward side and moveable in a linear direction between an extended and a retracted position.

12. A container according to claim 11, wherein the locking tab extends in a direction which is parallel with the linear direction that the drawer component travels.

* * * * *